US006913443B2

(12) United States Patent
Chen

(10) Patent No.: US 6,913,443 B2
(45) Date of Patent: Jul. 5, 2005

(54) OSCILLATING MEANS FOR MULTI-FAN ASSEMBLY

(76) Inventor: Chia-Teh Chen, 5Fl., No. 30, Yi Shian Rd., Sung Shan Chu, Taipei (TW)

( * ) Notice: Subject to any disclaimer, the term of this patent is extended or adjusted under 35 U.S.C. 154(b) by 0 days.

(21) Appl. No.: 10/742,001

(22) Filed: Dec. 19, 2003

(65) Prior Publication Data

US 2004/0191066 A1 Sep. 30, 2004

(30) Foreign Application Priority Data

Mar. 31, 2003 (TW) ..... 92204991 U

(51) Int. Cl.[7] ..... F04D 29/34

(52) U.S. Cl. ..... 416/99; 416/5; 416/100; 416/110; 417/423.3; 417/423.5

(58) Field of Search ..... 416/5, 170 R, 416/98, 99, 100, 108, 110, 111; 417/53, 423.3, 423.1, 423.5

(56) References Cited

U.S. PATENT DOCUMENTS 1,577,461 A * 3/1926 Glasser ..... 416/98
4,730,981 A * 3/1988 Kawai ..... 416/170 R
6,364,638 B1 * 4/2002 Liu ..... 416/5
6,722,859 B1 * 4/2004 Chen ..... 416/98
6,817,830 B1 * 11/2004 Chen ..... 415/60
6,832,902 B2 * 12/2004 Gajewski et al. ..... 416/99

FOREIGN PATENT DOCUMENTS

GB 134971 A * 11/1919 ..... 416/5
JP 62-48997 A * 3/1987 ..... 416/170 R

* cited by examiner

*Primary Examiner*—Christopher Verdier
(74) *Attorney, Agent, or Firm*—Charles E. Baxley

(57) ABSTRACT

An oscillating arrangement for a multi-fan assembly includes a down rod assembly which is provided for connecting to a hanging assembly, on the hanging assembly is provided two sets of fixing arms which extend outwardly, two member fans are respectively mounted to the fixing arms of the hanging assembly, an end of a driving shaft of each member fan is provided with fan blades. The characteristic is that each set of the fixing arms is pivotally connected to an oscillating arrangement on which a member fan can be disposed. On the oscillating arrangement is further defined a gear cluster which is actuated by the member fan's motor, and a connecting assembly which is driven by the gear cluster. In this manner, the member fans are able to oscillate vertically.

10 Claims, 7 Drawing Sheets

OSCILLATING MEANS FOR MULTI-FAN ASSEMBLY

BACKGROUND OF THE INVENTION

1. Field of the Invention

The present invention relates to a ceiling fan assembly, and more particularly to an oscillating means for a multi-fan assembly.

2. Description of the Prior Arts

To avoid confusion during the course of this presentation, here are definitions for some words used in following descriptions as below:

Rotation: the spinning of fan blades of the member fan around its own axis or the circular movement of a rotatable member moving around a central shaft.

Revolution: the circular movement of two or more member fans rotating about a common central main shaft.

A Conventional ceiling fan assembly is normally provided with two member fans outside of a hanging assembly, however, the member fans are unable to vertically oscillate for providing cooling air, which are normally fixed at a certain pitching angle. Since the users don't want the fans to blow directly on them, they would like to make the air circulate by taking use of flow of the air in vertical direction, so as to enjoy the cool air comfortably. Furthermore, due to the pitching angle of the member fans being fixed and unchangeable during the revolution of the hanging assembly, it only can be adjusted by a manual way, it is very laborsome and time-consuming.

The present invention has arisen to mitigate and/or obviate the afore-described disadvantages of the conventional multi-fan assembly.

SUMMARY OF THE INVENTION

The primary object of the present invention is to provide an oscillating means for a multi-fan assembly having plural member fans, besides being capable of overcoming the above-mentioned disadvantages, which still has the distinct functions as follows:

1. The multi-fan assembly is exteriorly provided with a motor for actuating a gear cluster and a connecting rod, so as to make the member fans oscillate vertically, such that besides the rotation function, the member fans are able to provide cooling air by a method of vertical oscillation, that is to provide cool air at a full three dimensional circumferential angle.

2. With a servo motor which is used to actuate a gear cluster and a connecting rod, besides a rotation function, the member fans are able to provide cooling air by a method of vertical oscillation, that is to provide cool air at a full three dimensional circumferential angle.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENTS

Figure 1:
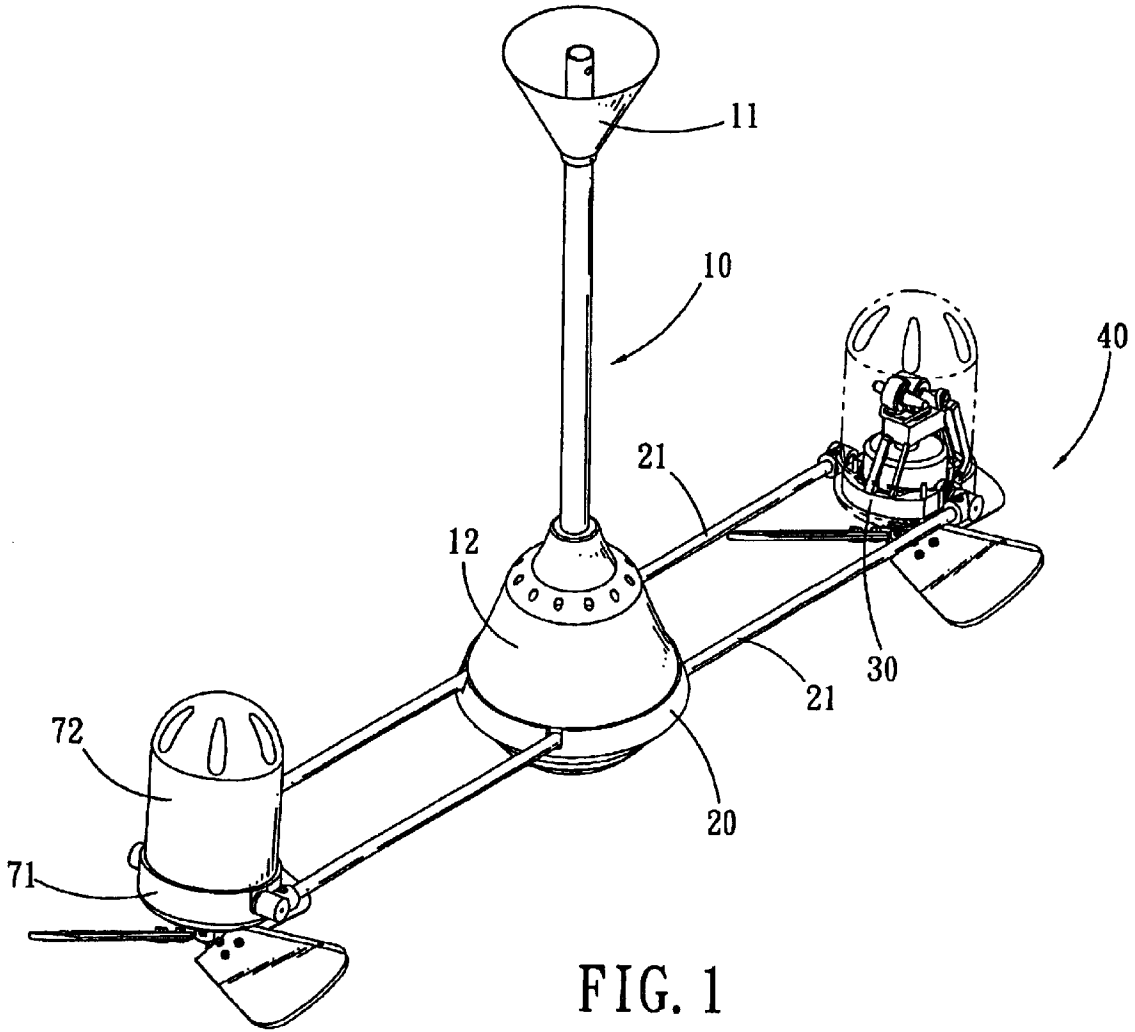
FIG. 1 is a perspective view of an oscillating means for a multi-fan assembly in accordance with a first embodiment of the present invention.
Figure 2:
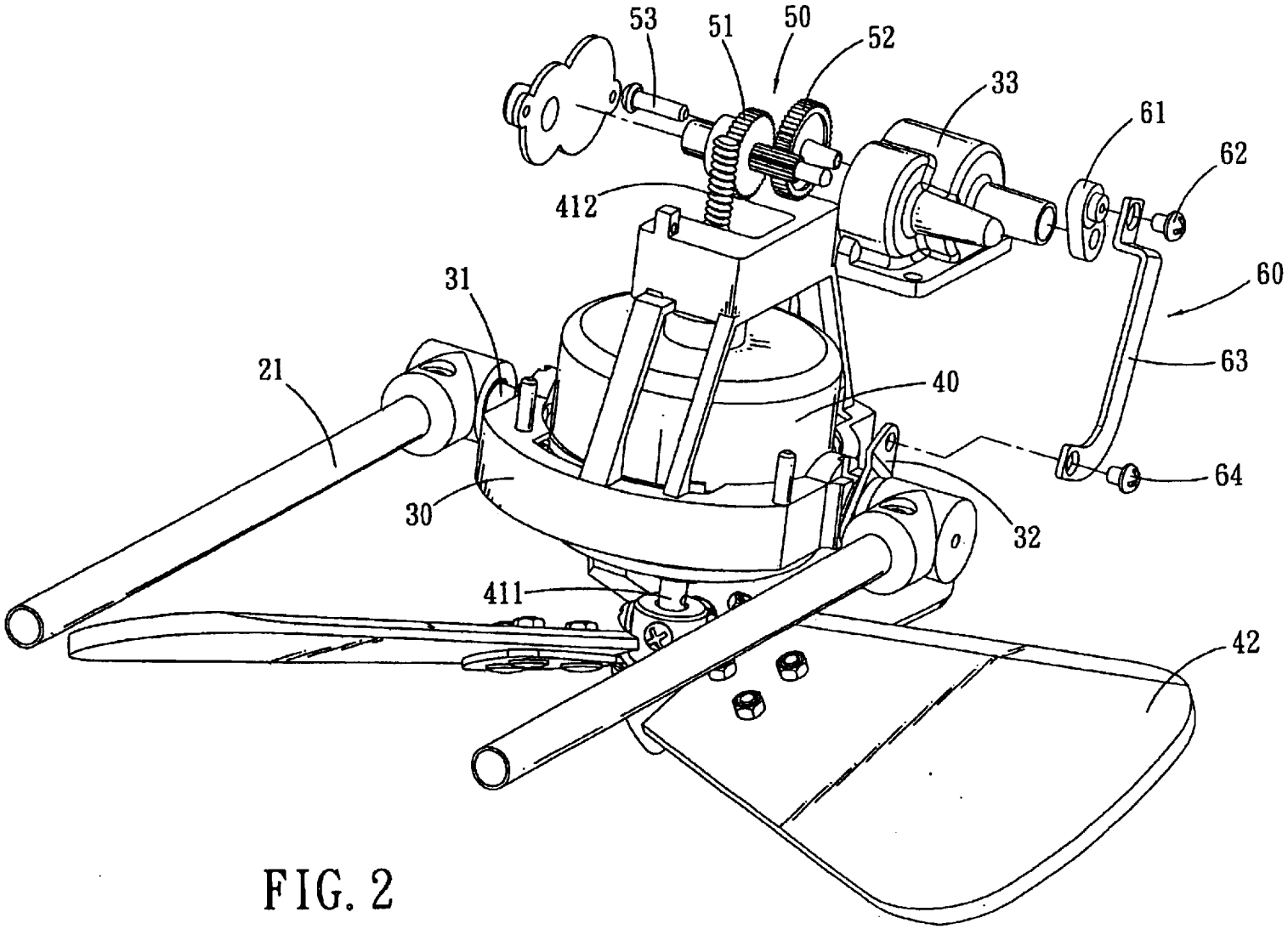
FIG. 2 is a partial exploded view of an oscillating means for a multi-fan assembly in accordance with a first embodiment of the present invention.
Figure 3:
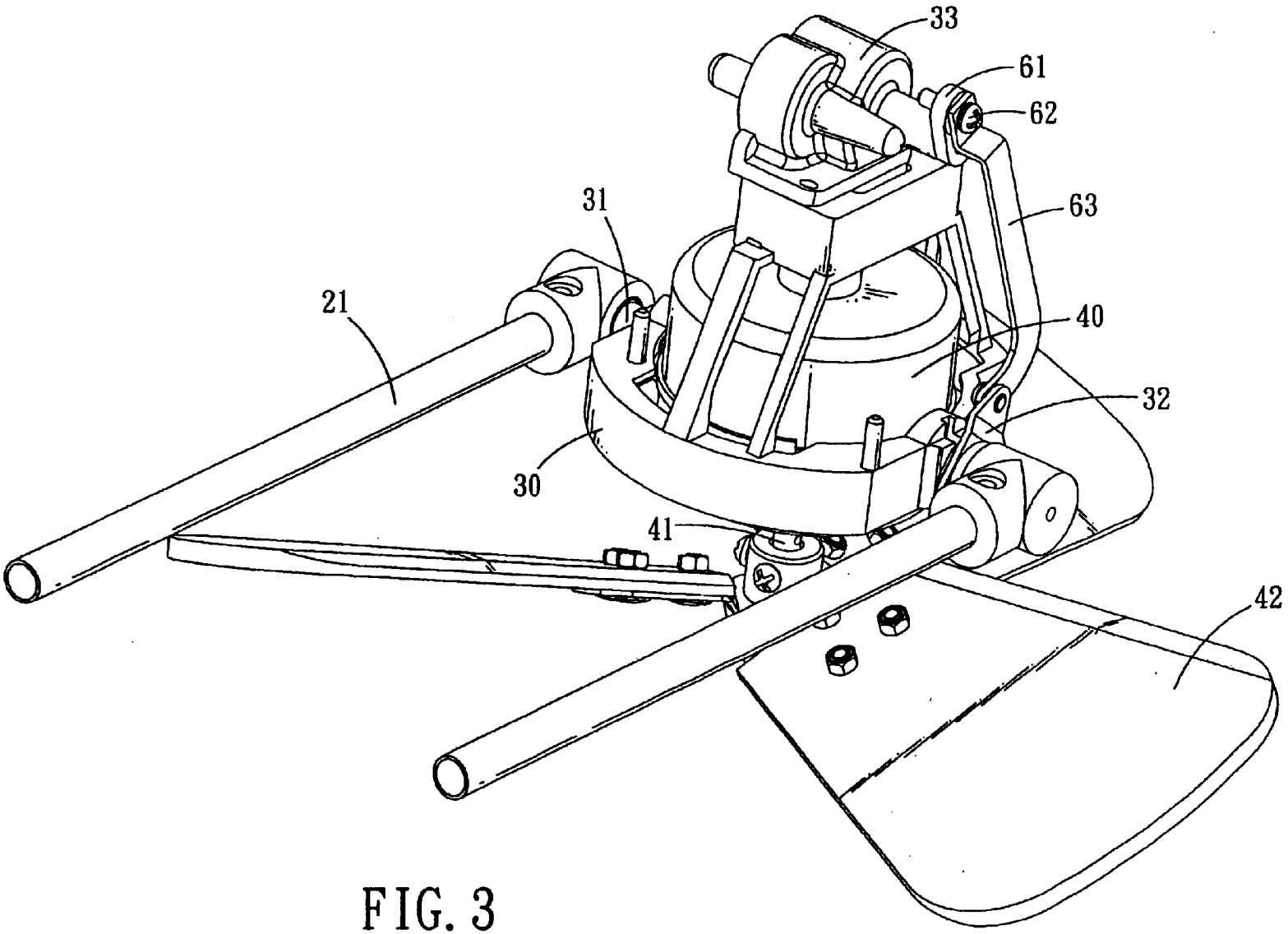
FIG. 3 is a perspective assembly view of an oscillating means for a multi-fan assembly in FIG. 2.

Referring to FIGS. 1–3, a multi-fan assembly in accordance with a first embodiment of the present invention is shown and generally comprises: a down rod assembly 10, a hanging assembly 20, a pair of oscillating means 30, a pair of member fans 40, a pair of gear clusters 50, a pair of connecting assemblies 60, two lower covers 71 and two top covers 72.

The down rod assembly 10, a first end of which is provided with a hanging bell 11 for fixing to ceiling wall and a second end of which is connected to a canopy 12.

The hanging assembly 20 is fixed to the second end of the down rod assembly 10, which is provided with two sets of fixing arms 21 which extend outwardly.

The oscillating means 30, via a pivot 31, are respectively pivotally mounted on the corresponding fixing arms 21 of the hanging assembly 20. Each pivot 31 is provided with a driving piece 32, and each oscillating means 30 is provided at its rear end with an outer cover 33.

The two member fans 40 are fixed to the corresponding oscillating means 30 respectively, a first end 411 of a driving shaft 41 of the each member fan 40 is mounted with fan blades 42, and a second end 412 of the driving shaft 41 is located in the outer cover 33.

The two gear clusters 50 are disposed on their corresponding oscillating means 30 and each of which is covered with the outer cover 33. Each gear cluster 50 includes a first gear 51 and a second gear 52, both of which mate with each other. The first gear 51 is connected to the second end 412 of the driving shaft 41 of the member fan 40, whereas the second gear 52 has a link member 53 which protrudes out of the outer over 33.

The two connecting assemblies 60 are disposed outside of their corresponding oscillating means 30, each connecting assembly 60 includes a first connecting rod 61, a first end of which is connected to a first end of a second connecting rod 63 via a fixing member 62. A second end of the first connecting rod 61 is connected to the link member 53 of the second gear 52, so as to achieve synchronous motion, whereas a second end of the second connecting rod 63 is connected to the driving piece 32 of the pivot 31 via a fixing member 64.

The two lower covers 71 and the two top covers 72 are employed to cover the two member fans 40 correspondingly, while the fan blades 42 of the member fans 40 are located outside the cover for aesthetic purpose.

Referring again to FIGS. 2–3, in operation, each of the member fans 40 on the corresponding fixing arms 21 at both sides of the hanging assembly 20 uses the driving shaft 41 to rotate the fan blades 42, so as to create air-flow. Meanwhile, the second end 412 of the driving shaft 41 of the each member fan 40 drives the first gear 51 to rotate, and the second gear 52 will rotate synchronously with the first gear 51. And thus, the second gear 52 is able to drive the corresponding connecting assembly 60 to move. Since the second connecting rod 63 of the connecting assembly 60 is connected to the driving piece 32, and the driving piece 32 is integrally fixed to the pivot 31, in this case, the pivot 31 will be driven to rotate during the operation of the ceiling fan. And the oscillating means 30 fixed to the pivot will oscillate accordingly, which makes the corresponding member fans 40 on the oscillating means 30 oscillate vertically, such that the member fans 40 are capable of performing vertical oscillation for providing cool air through air circulation.

Figure 4:
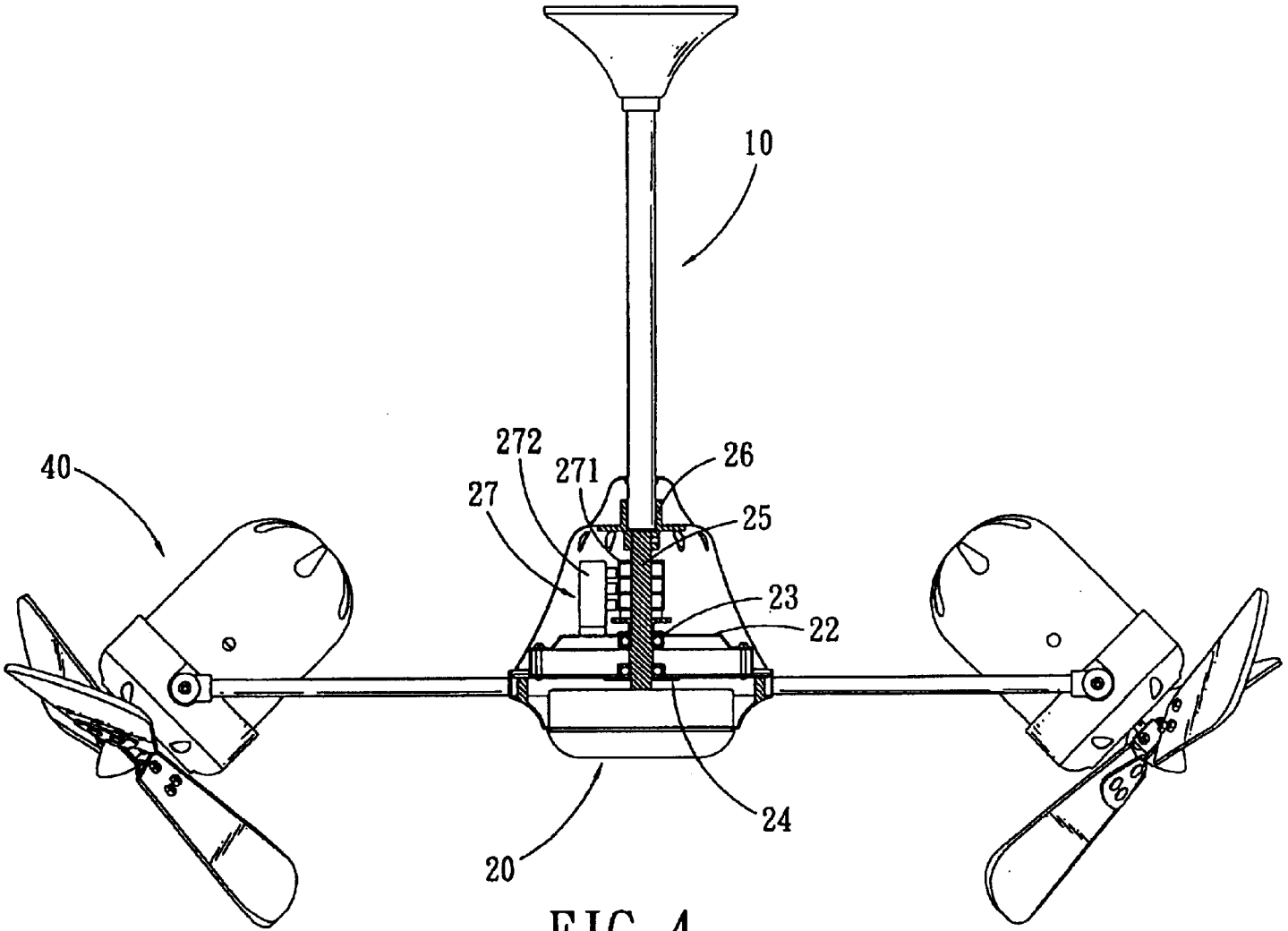
FIG. 4 is an operational application of the present invention showing the member fans performing both vertical oscillation and horizontal revolution for cooling the room temperature thru air circulation.

It will be noted that, as shown in FIG. 4, in the hanging assembly 20 is provided with a rotor plate 22 which is rotatably connected to a first end of a rod 25 through a shaft bearing 23 and an arresting member 24, a second end of the rod 25 is locked together with the down rod assembly 10 via a fixing member 26. The rotor plate 22 is provided with a current conducting device 27 which is comprised of a first conducting member 271 and a second conducting member 272. The first conducting member 271 is mounted on the rod 25, whereas the second conducting member 272 is disposed on the rotor plate 22 and keeps contacting the first conducting member 271 for conducting current. In this manner, the member fans 40 at both sides of the hanging assembly 20 are electrified via the current conducting device 27 and thus are able to oscillate vertically. When the member fans 40 move to a specified angle during their vertical oscillation motion, with the help of the wind force generated by the member fans 40, the hanging assembly 20 will revolve about the down rod assembly 10, so as to create revolution. By this manner, the member fans 40 are capable of performing both vertical oscillation and horizontal revolution for cooling room temperature thru air circulation.

Figure 5:
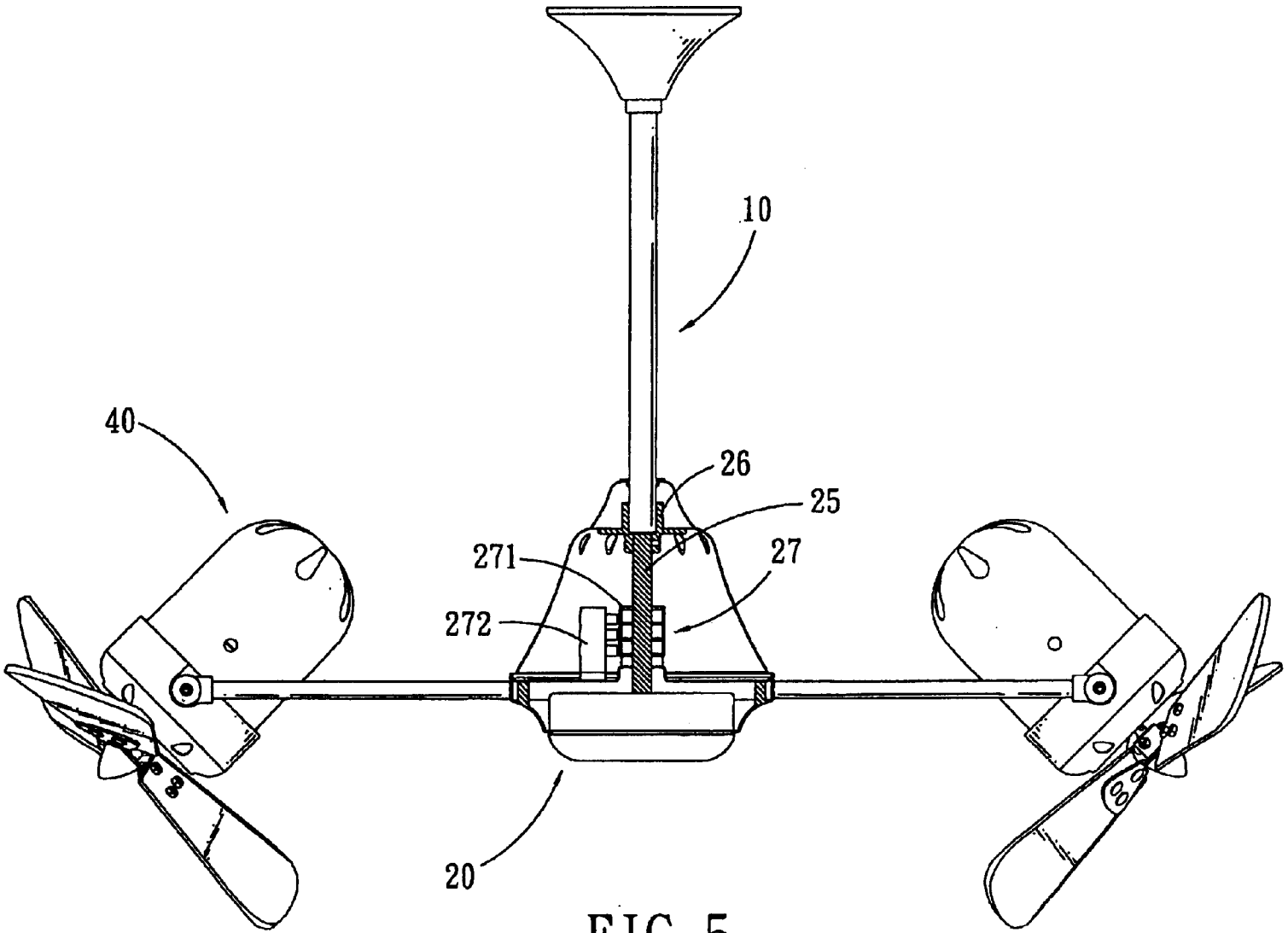
FIG. 5 is another operational application of the present invention wherein the member fans are unable to revolve about the central rod of the multi-fan assembly.

Referring to FIG. 5, a rod 25 is provided in the hanging assembly 20 and fixedly locked together with the down rod 10 via a fixing member 26. The hanging assembly 20 is further provided with a current conducting device 27 which includes a first conducting member 271 and a second conducting member 272. The first conducting member 271 is mounted on the rod 25, whereas the second conducting member 272 is disposed on the rotor plate 22 and keeps contacting the first conducting member 271 for conducting current. In this manner, the member fans 40 at both sides of the hanging assembly 20 are electrified via the current conducting device 27 and thus are able to oscillate vertically. When the member fans 40 move to an arbitrary angle during their vertical oscillation motion, since the hanging assembly 20 is unrotatably fixed to the hanging assembly 10, the member fans 40 are unable to revolve about the hanging assembly 20.

Figure 6:
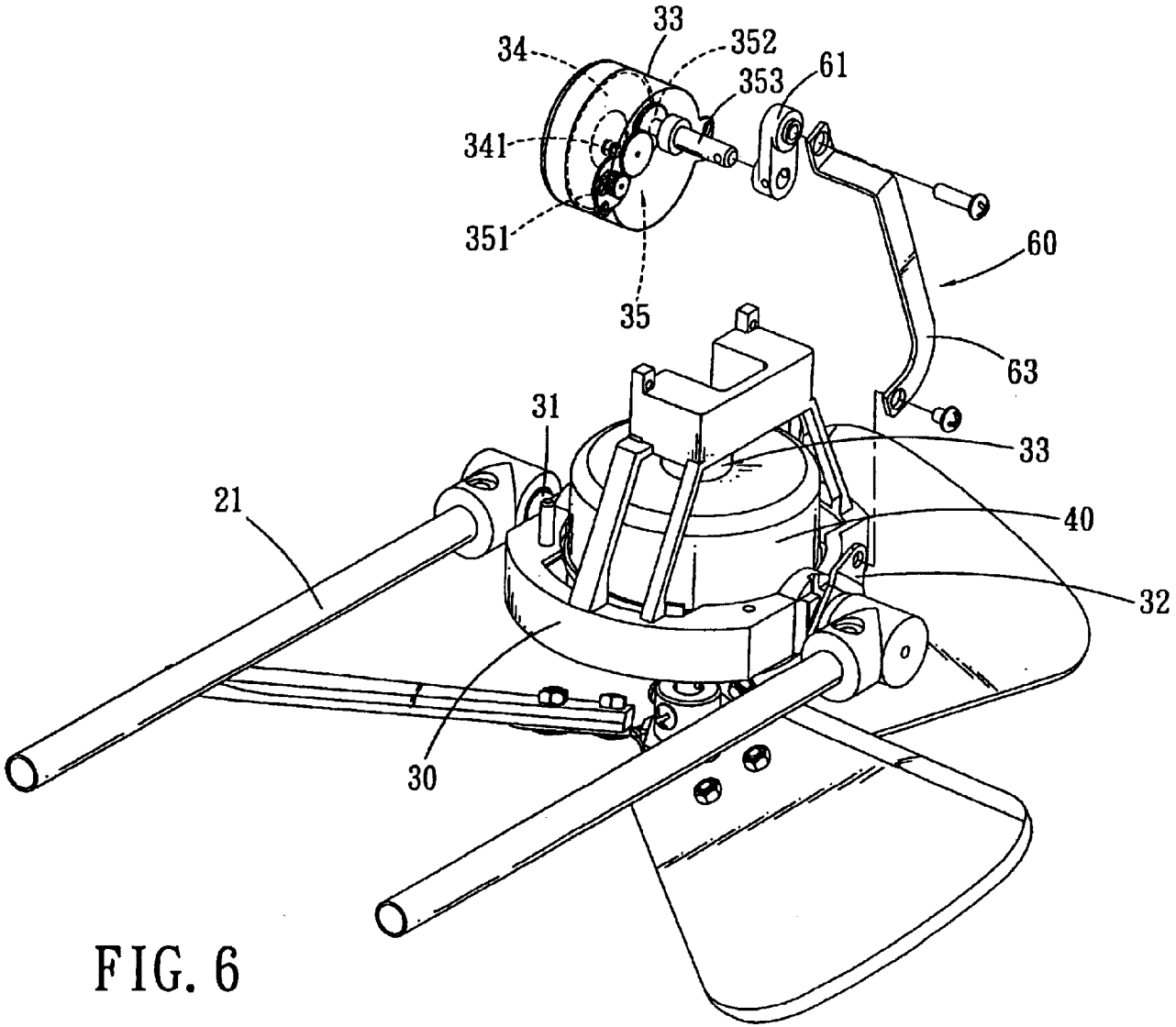
FIG. 6 is a partial exploded view of an oscillating means for a multi-fan assembly in accordance with a second embodiment of the present invention.
Figure 7:
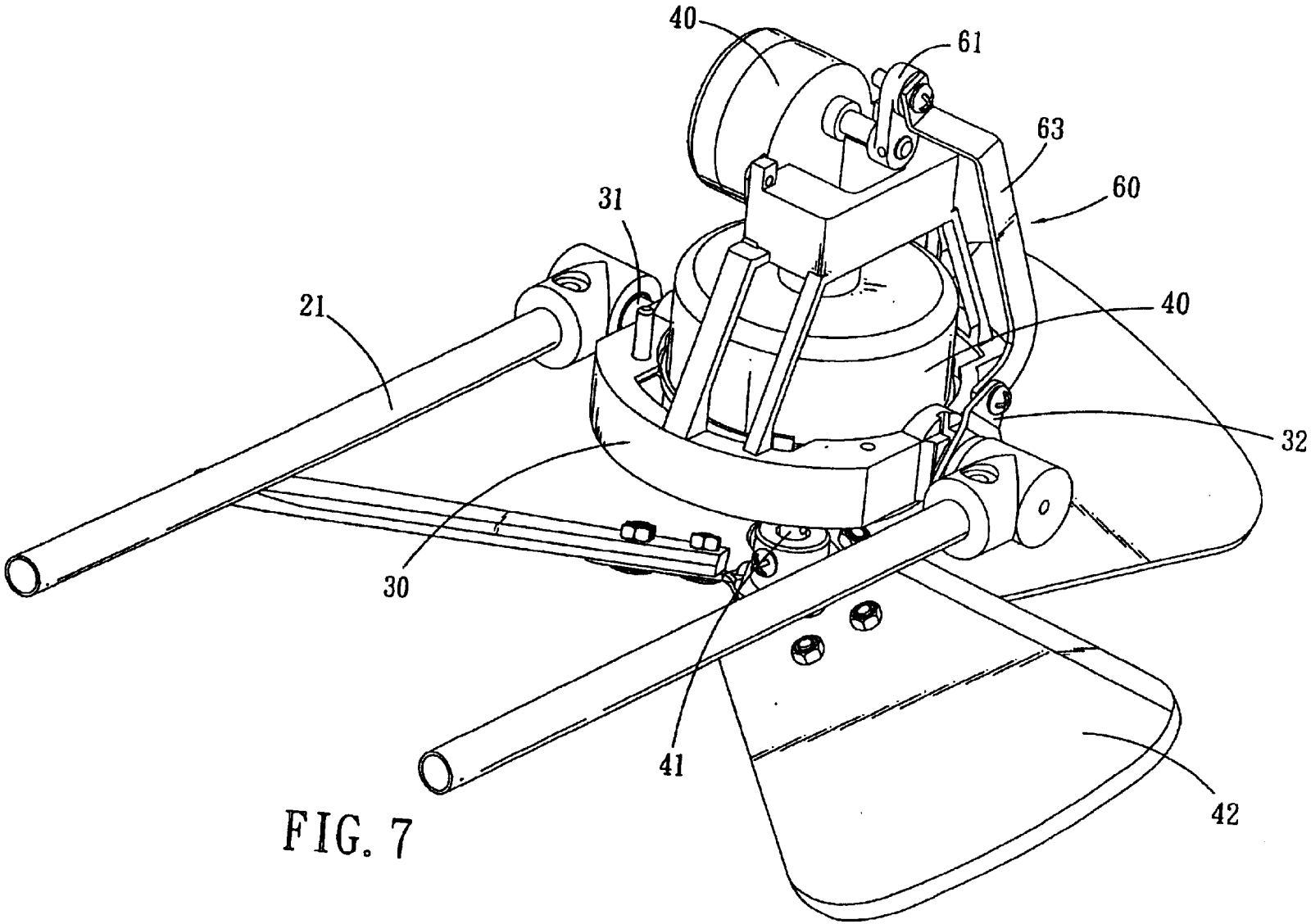
FIG. 7 is a perspective assembly view of an oscillating means for a multi-fan assembly in FIG. 6.

Referring to FIGS. 6 and 7, a multi-fan in accordance with a second embodiment of the present invention is shown and its structure is similar to that of the first embodiment, so further remarks on this matter would seem superfluous. Here are only described some differences of the multi-fan in accordance with the second embodiment with respect to that of the first one, which are as follows:

The outer cover 33 of each oscillating mean 30 in accordance with the second embodiment of the present invention is interiorly provided with a servo motor 34 and a gear cluster 35. A driving shaft 341 of the servo motor 34 is connected to a first gear 351 of the gear cluster 35, whereas a second gear 352 of the gear cluster 35 also has a connecting member 353 which extends out of the outer cover 33. The connecting member 353 is connected to the first connecting rod 61 of the connecting assembly 60, and the second connecting rod 63 of the connecting assembly 60 is connected to the driving piece 32 of the pivot 31.

During operation of the ceiling fan, each of the two member fans 40 on the fixing arms 21 at both sides of the hanging assembly (not shown) use the driving shaft 41 to rotate the fan blades 42, so as to create air-flow. Meanwhile, the driving shaft 341 of the servo motor 34 drives the first gear 351 to rotate, and the second gear 352 will rotate synchronously with the first gear 351. And thus, the second gear 352 is able to drive the corresponding connecting assembly 60 to move. Since the second connecting rod 63 of the connecting assembly 60 is connected to the driving piece 32, and the driving piece 32 is integrally fixed to the pivot 31, in this case, the pivot 31 will be driven to rotate during the operation of the ceiling fan. And the oscillating means 30 fixed to the pivot 31 will oscillate accordingly, which makes the corresponding member fans 40 on the oscillating means 30 oscillate vertically, such that the member fans 40 are capable of performing vertical oscillation for cooling room temperature through air circulation.

In addition, since the servo motor 34 can be electrically connected with a current control unit, the current control unit is able to control the current in the servo motor 34 by method of wire or remote control so as to change the rotational speed of the servo motor 34. With the differential transmission of the gear cluster 35, the oscillating motion of the member fans can be accelerated or decelerated.

In like manner of the first embodiment, the hanging assembly of the second embodiment can be interiorly provided with a rotor plate which is rotatably connected to the rod. The rotor plate is provided with a current conducting device for electrifying the member fans and making them oscillate vertically. When the member fans move to a specified angle during their vertical oscillation motion, with the help of the wind force generated by the member fans, the hanging assembly will revolve about the down rod assembly, so as to create revolution. By this manner, the member fans are capable of performing both vertical oscillation and horizontal revolution for cooling room temperature through air circulation. On the other hand, on the hanging assembly can be integrally formed with a rod, and the hanging assembly is further provided with a current conducting device for electrifying the member fans. When moving to an arbitrary angle during their vertical oscillation motion, the member fans are unable to revolve about the hanging assembly.

While we have shown and described various embodiments in accordance with the present invention, it should be clear to those skilled in the art that further embodiments may be made without departing from the scope of the present invention.

What is claimed is:

1. An oscillating type multi-fan assembly comprising:

a down rod assembly, a first end of which is fixed to a ceiling wall;

a hanging assembly fixed to a second end of the down rod assembly, which is provided with two sets of fixing arms extending outwardly;

two member fans fixed to the fixing arms respectively, an end of a driving shaft of each of the member fans mounted with fan blades;

wherein a pivot is provided on the fixing arm of the hanging assembly for pivotally connecting to an oscillating means, each of the member fans is mounted on the corresponding oscillating means, on the oscillating means is further provided a gear cluster, a first gear of the gear cluster is connected to a second end of the driving shaft of the member fan, a connecting assembly is provided outside of the oscillating means, a first connecting rod of the connecting assembly is connected to a second gear of the gear cluster, a second connecting rod of the connecting assembly is connected to the pivot.

2. The oscillating type multi-fan assembly as claimed in claim 1, wherein a driving piece is fixedly provided on the pivot for connecting to the second connecting rod of the connecting assembly.

3. The oscillating type multi-fan assembly as claimed in claim 1, wherein each of the member fans is provided with a top cover and a lower cover, the fan blades of the member fans are located outside of the top and the lower covers.

4. The oscillating type multi-fan assembly as claimed in claim 1, wherein a rotor plate is provided in the hanging assembly, the rotor plate is provided for rotatably connecting to a first end of a rod, a second end of the rod is fixed to the down rod assembly, on the rotor plate is provided a current conducting device which is used to electrify the member fans.

5. The oscillating type multi-fan assembly as claimed in claim 1, wherein a rod is provided in the hanging assembly, an end of the rod is rigidly fixed to the down rod assembly.

6. An oscillating type multi-fan assembly comprising:

a down rod assembly, a first end of which is fixed to a ceiling wall;

a hanging assembly fixed to a second end of the down rod assembly, which is provided with two sets of fixing arms extending outwardly;

two member fans fixed to the fixing arms respectively, an end of a driving shaft of each of the member fans mounted with fan blades;

wherein a pivot is provided on the fixing arm of the hanging assembly for pivotally connecting to an oscillating means, each of the member fans is mounted on the corresponding oscillating means, on the oscillating means is further provided a servo motor and a gear cluster, a driving shaft of the servo motor is connected to a first gear of the gear cluster, a connecting assembly is provided outside of the oscillating means, a first connecting rod of the connecting assembly is connected to a second gear of the gear cluster, a second connecting rod of the connecting assembly is connected to the pivot.

7. The oscillating type multi-fan assembly as claimed in claim 6, wherein a driving piece is fixedly provided on the pivot for connecting to the second connecting rod of the connecting assembly.

8. The oscillating type multi-fan assembly as claimed in claim 6, wherein each of the member fans is provided with a top cover and a lower cover, the fan blades of the member fans are located outside of the top and the lower covers.

9. The oscillating type multi-fan assembly as claimed in claim 6, wherein a rotor plate is provided in the hanging assembly, the rotor plate is provided for rotatably connecting to a first end of a rod, a second end of the rod is fixed to the down rod assembly, on the rotor plate is provided a current conducting device which is used to electrify the member fans.

10. The oscillating type multi-fan assembly as claimed in claim 6, wherein a rod is provided in the hanging assembly, an end of the rod is fixed to the down rod assembly.

* * * * *